US010584909B2

(12) United States Patent
Bing et al.

(10) Patent No.: US 10,584,909 B2
(45) Date of Patent: Mar. 10, 2020

(54) THERMOELECTRIC INSULATED COOLER FOR MOTORCYCLES

(71) Applicants: Charlotte A. Bing, Spearfish, SD (US); Charles Smith, Lead, SD (US)

(72) Inventors: Charlotte A. Bing, Spearfish, SD (US); Charles Smith, Lead, SD (US)

( * ) Notice: Subject to any disclaimer, the term of this patent is extended or adjusted under 35 U.S.C. 154(b) by 67 days.

(21) Appl. No.: 15/896,268

(22) Filed: Feb. 14, 2018

(65) Prior Publication Data

US 2018/0180343 A1 Jun. 28, 2018

Related U.S. Application Data

(63) Continuation-in-part of application No. 14/863,906, filed on Sep. 24, 2015, now abandoned.

(51) Int. Cl.
*F25B 21/00* (2006.01)
*F25D 19/00* (2006.01)
(Continued)

(52) U.S. Cl.
CPC ..... *F25D 11/003* (2013.01); *F25D 11/00* (2013.01); *F25D 16/00* (2013.01); *F25D 23/025* (2013.01);
(Continued)

(58) Field of Classification Search
CPC ..... F25B 21/00; F25B 21/02; F25B 21/04; F25D 2400/12; F25D 19/003; F25D 23/04; F25D 31/006; F25D 31/007; F25D 2331/80; F25D 2331/809; B60H 1/00264; B60H 1/00478; A45C 2005/1013; B65D 3/02; B65D 3/268; B65D 23/104; B65D 25/2873; B65D 25/2876; B65D 45/34; B65D 45/345; B65D 2563/00; B65D 2563/102; B65D 2563/103;
(Continued)

(56) References Cited

U.S. PATENT DOCUMENTS 5,042,258 A * 8/1991 Sundhar ..... A47G 19/2288 62/3.2
7,198,512 B1 * 4/2007 Swiatek ..... B62J 9/008 224/902

(Continued)

*Primary Examiner* — Frantz F Jules
*Assistant Examiner* — Erik Mendoza-Wilkenfel
(74) *Attorney, Agent, or Firm* — Dale J. Ream

(57) ABSTRACT

A thermoelectric cooling apparatus for use with a motorcycle includes a housing having a bottom wall and a wall structure extending upwardly that defines an interior area and an open top providing selective access to the interior area. A conductive lining is situated adjacent to the insulation layer that includes an aluminum cooling plate upwardly displaced from the bottom wall such that the bottom wall, the wall structure and the cooling plate defining a hollow compartment. The cooling apparatus is mounted to a motorcycle with mounting straps and locked with a locking assembly. A thermoelectric assembly is situated in the compartment having a "cool" side coupled to a lower surface of the cooling plate of the lining and an opposed "hot" side, the thermoelectric assembly configured to electrically connect to the battery of the motorcycle such that the thermoelectric assembly conductively cools the cooling plate and the lining when actuated.

18 Claims, 14 Drawing Sheets

(51) Int. Cl.

| | |
|---|---|
| ***F25D 23/04*** | (2006.01) |
| ***B65D 3/02*** | (2006.01) |
| ***B62J 11/00*** | (2006.01) |
| ***B62J 7/02*** | (2006.01) |
| ***B65D 45/34*** | (2006.01) |
| ***F25D 11/00*** | (2006.01) |
| ***F25D 16/00*** | (2006.01) |
| ***F25D 23/02*** | (2006.01) |
| ***F25D 23/10*** | (2006.01) |
| *F25B 21/02* | (2006.01) |

(52) U.S. Cl.
CPC ..... *F25D 23/10* (2013.01); *F25B 21/02* (2013.01); *F25B 2321/0251* (2013.01); *F25D 2400/12* (2013.01)

(58) Field of Classification Search
CPC ..... B65D 2563/107; B65D 2563/108; B62J 7/02; B62J 7/04; B62J 7/06; B62J 7/08; B62J 11/00; B62J 11/02; B62J 9/001
See application file for complete search history.

(56) References Cited

U.S. PATENT DOCUMENTS

2003/0015538 A1* 1/2003 Lassiter ..... B65D 81/3876 220/592.18
2016/0003503 A1* 1/2016 Novisoff ..... F25B 21/02 62/3.3

* cited by examiner

THERMOELECTRIC INSULATED COOLER FOR MOTORCYCLES

REFERENCE TO RELATED APPLICATIONS

This application is a continuation-in-part of and claims the priority of now-pending application U.S. Ser. No. 14/863,906 filed Sep. 24, 2015 titled Thermoelectric Insulated Cooler For Motorcycles and which is incorporated herein by reference.

BACKGROUND OF THE INVENTION

This invention relates generally to portable cooling devices and, more particularly, to a thermoelectrically powered insulated cooler attachable to a motorcycle for keeping food and beverage items cold while riding.

Insulated coolers filled substantially filled with crushed ice are common for keeping food and beverage items cool during picnics, sporting events, and even long road trips in the car. Unfortunately, filling a traditional ice chest with ice has several disadvantages that make their use undesirable in some circumstances. For instance, the cooler becomes very heavy once filled with ice and makes transporting it from a vehicle to a final location (or the first of several locations) very difficult, especially for children or persons of small stature. Further, the ice eventually melts, despite any degree of insulation, and the cooler remains just as heavy while food items may become soggy or even spoil.

The problems described above are elevated even more if such a cooler is transported on a motorcycle. Persons who ride a motorcycle have a similar desire to carry food and beverage items in a cooled environment for consumption at a destination location, e.g. a picnic, at the beach, etc, or along the way during a long road trip. A large and heavy cooler is not feasible to attach to a motorcycle for space reasons or because of the weight imbalance it would create while operating the motorcycle.

Therefore, it would be desirable to have a thermoelectric insulated cooler apparatus that is configured for attachment to a motorcycle and which does not upset the natural balance of the motorcycle nor require any ice. Further, it would be desirable to have a thermoelectric insulated cooler apparatus that includes a thermoelectric assembly that produces cold thermal energy when electrically energized by the motorcycles battery. In addition, it would be desirable to have a thermoelectric insulated cooler apparatus having anti-theft features to eliminate concern of theft when the motorcycle is parked at a restaurant, rest stop, or the like.

SUMMARY OF THE INVENTION

A thermoelectric cooling apparatus for use with a motorcycle according to the present invention includes a housing having a bottom wall and a continuous side wall extending upwardly from the bottom wall that defines an interior area and an open top that provides access to the interior area. A lid is pivotally provides access to the interior area. An insulation layer is coupled to an inner surface of the wall structure of the housing. A conductive lining is situated adjacent to the insulation layer within the housing, the conductive lining having an aluminum cooling plate upwardly displaced from the bottom wall such that the bottom wall, the wall structure and the cooling plate defining a hollow compartment. A locking assembly having a locking cable extending under a sleeve along the housing may be used to lock the housing to the motorcycle. A thermoelectric assembly is situated in the compartment having a "cool" side coupled to a lower surface of the cooling plate of the lining and an opposed "hot" side, the thermoelectric assembly configured to electrically connect to the battery of the motorcycle such that the thermoelectric assembly conductively cools the cooling plate and the lining when actuated.

Therefore, a general object of this invention is to provide a thermoelectric powered insulated cooling apparatus that is mountable to a motorcycle for keeping food and beverage items cool while riding.

Another object of this invention is to provide a thermoelectric powered insulated cooling apparatus, as aforesaid, that effectively maintains a cool temperature within a housing interior area without the addition of ice.

Still another object of this invention is to provide a thermoelectric powered insulated cooling apparatus, as aforesaid, in which a thermoelectric assembly positioned beneath a cooling plate of a conductive lining transfers cool thermal energy into an insulated interior area of a cooler housing.

Yet another object of this invention is to provide a thermoelectric powered insulated cooling apparatus, as aforesaid, that is easy to attach to a motorcycle and to electrically connect to the motorcycles electrical assembly.

A further object of this invention is to provide a thermoelectric powered insulated cooling apparatus, as aforesaid, having a locking assembly for locking the housing to the motorcycle.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
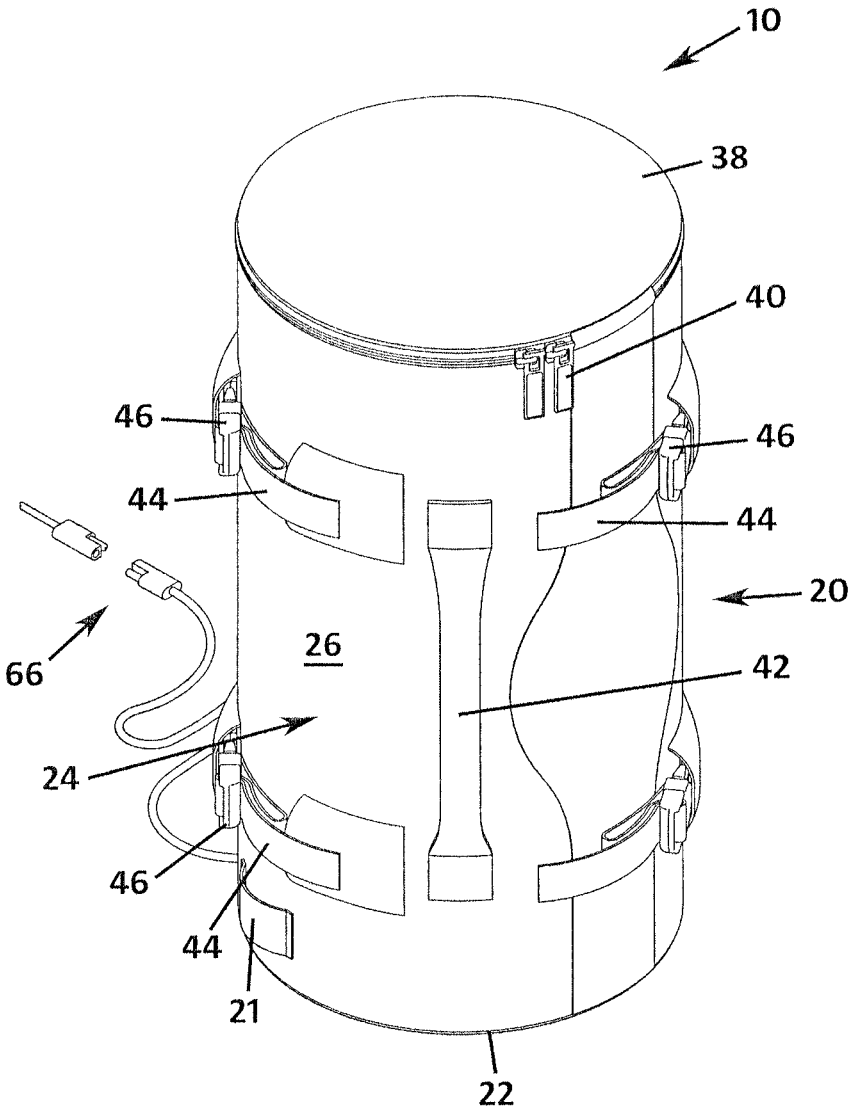
FIG. 1 is a perspective view of a thermoelectric insulated cooling apparatus according to a preferred embodiment of the present invention illustrated with a lid in a closed configuration.
Figure 2:
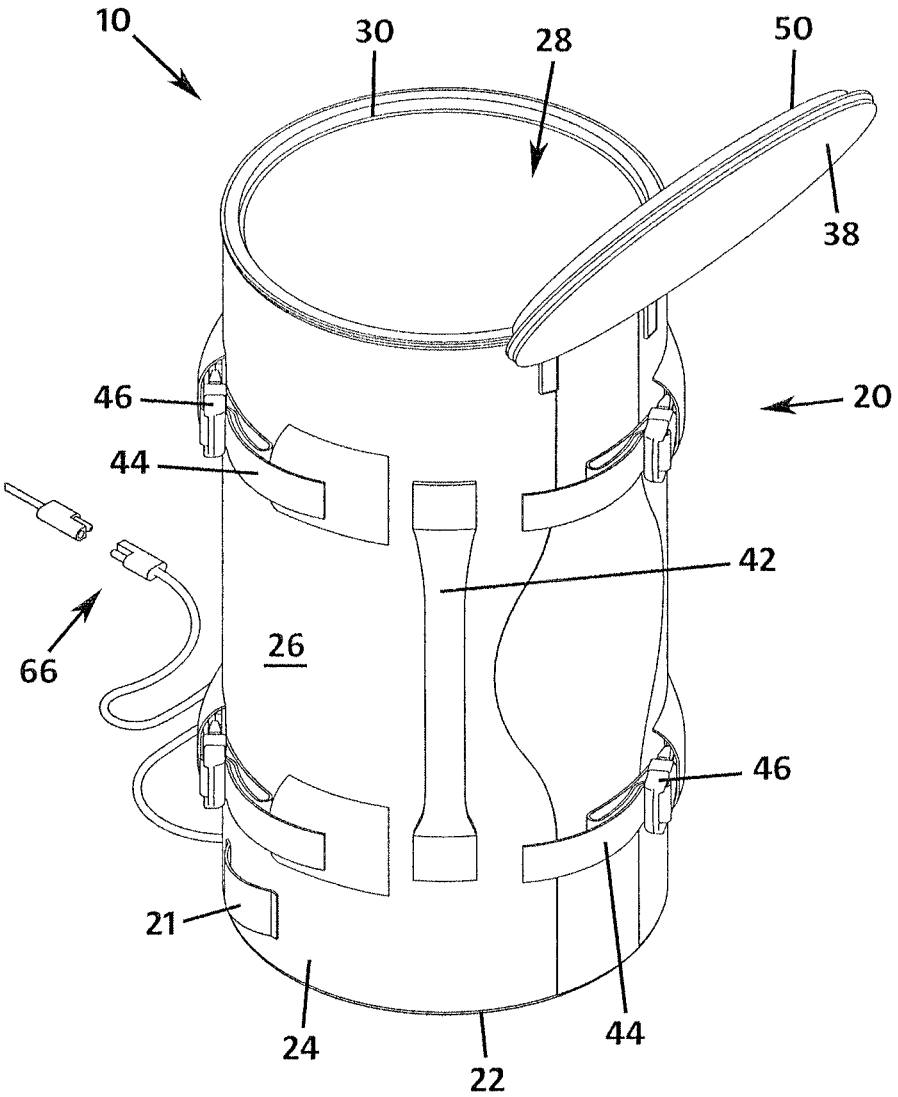
FIG. 2 is another perspective view of the thermoelectric insulated cooling apparatus as in FIG. 1, illustrated with the lid in an open configuration.
Figure 3:
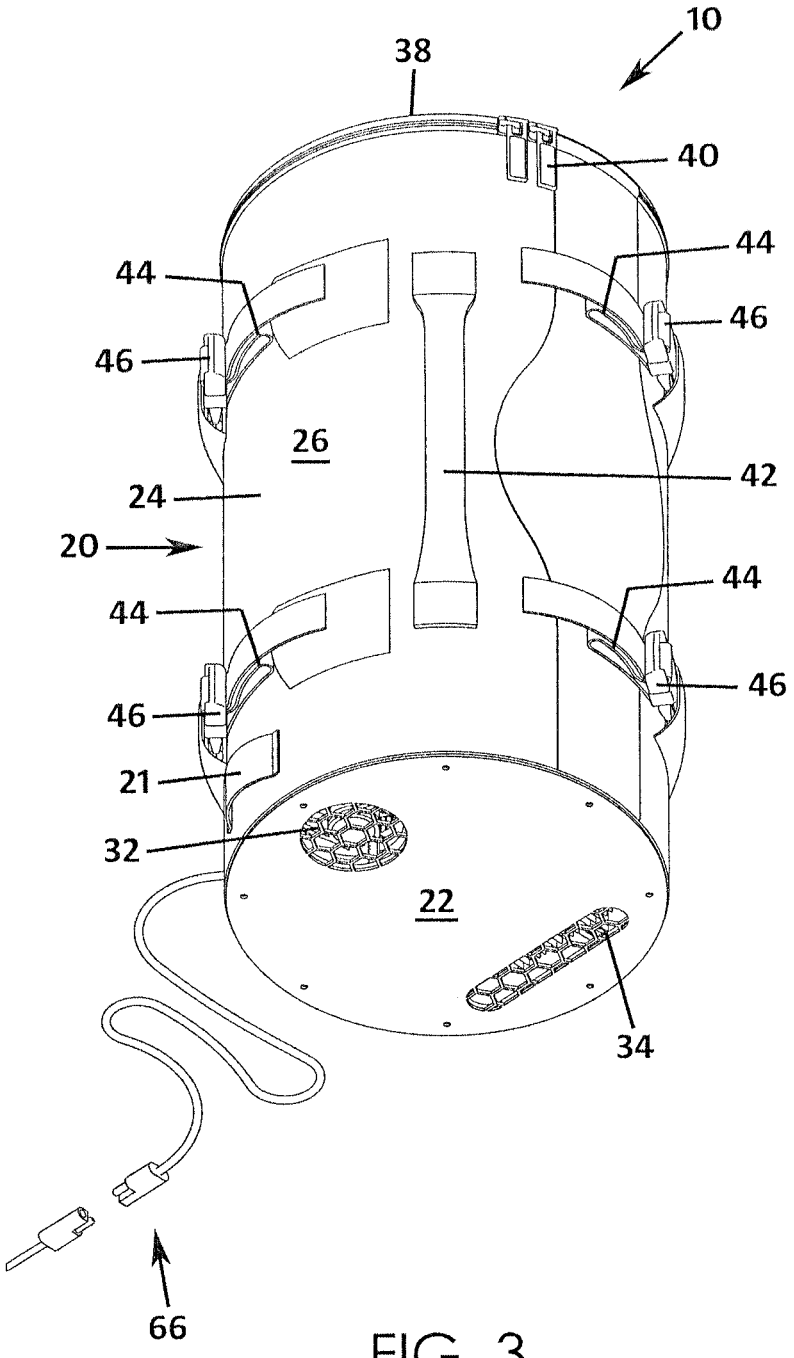
FIG. 3 is another perspective view from a lower elevation of the thermoelectric insulated cooling apparatus as in FIG. 1.

A thermoelectric cooling apparatus according to a preferred embodiment of the present invention will now be described in detail with reference to FIGS. 1 to 10*c* of the accompanying drawings. The thermoelectric cooling apparatus 10 includes a housing 20 defining an interior area and having an insulated layer 50 and a conductive lining 52. A thermoelectric assembly 60 is situated in a compartment 56 beneath a cooling plate 54 and is configured to cool the cooling plate 54 and conductive lining 52 while heat is exhausted from the housing 20.

The housing 20 includes a bottom wall 22 and a wall structure 24 extending upwardly from peripheral edges of the bottom wall 22. In an embodiment (shown in the accompanying drawings), the wall structure 24 may include a continuous side wall 26 arranged in a cylindrical configuration. In other words, the housing 20 may have a generally cylindrical arrangement that is conveniently strapped onto a rear seat or frame of a motorcycle. Together, the bottom wall 22 and wall structure 24 define a hollow interior area 28 and an open top 30 that allows access to the interior area 28.

The housing 20, however, may include a lid 38 pivotally or loosely coupled to an upper edge of the side wall 26 and movable between an open configuration (FIG. 2) allowing access to the interior area 28 and a closed configuration (FIG. 1) not allowing access to the interior area 28. The lid 38 may be selectively coupled with a fastener 40 such as a zipper (FIG. 1), latch, clasp, buckle, hook and loop combination, magnet combination, or the like. In one embodiment (not shown), a lid may be selectively held in a friction fit engagement and completely removed with gentle lifting force, as is the case in some traditional food and beverage coolers.

Figure 4A:
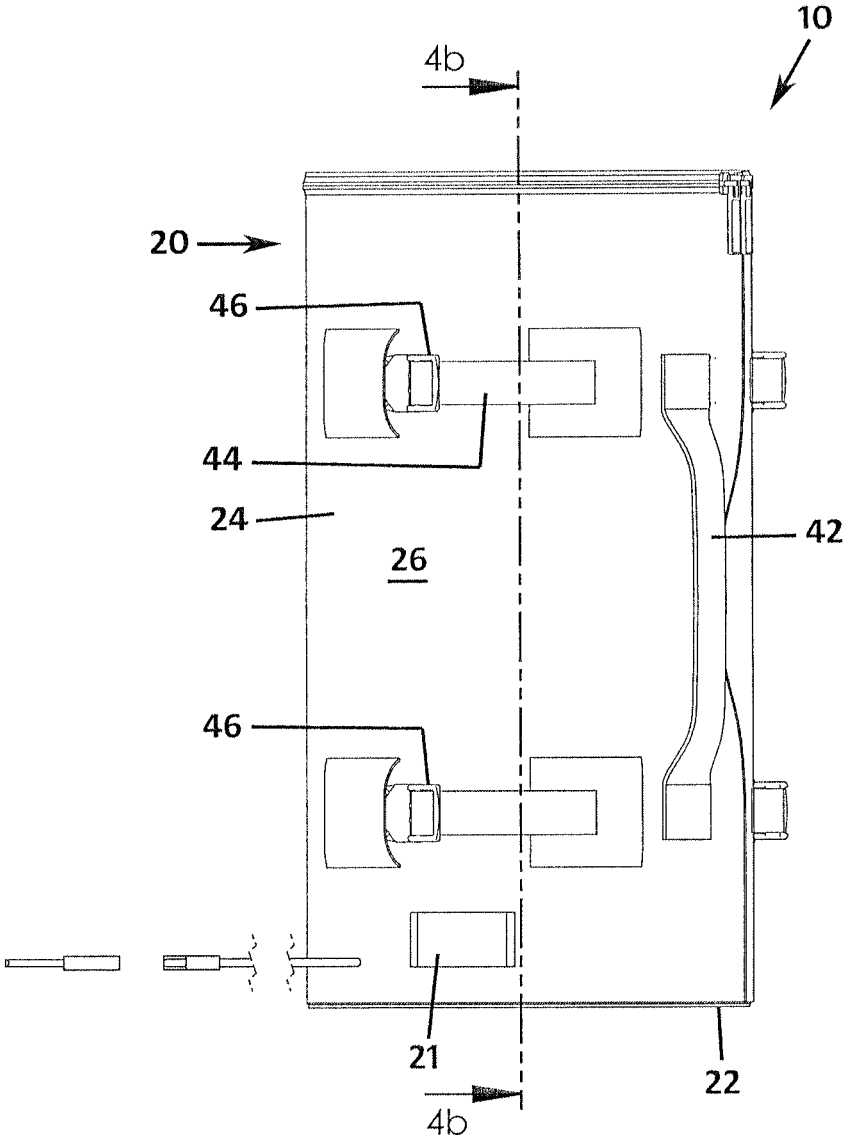
FIG. 4*a* is a side view of the thermoelectric insulated cooling apparatus as in FIG. 1.
Figure 4B:
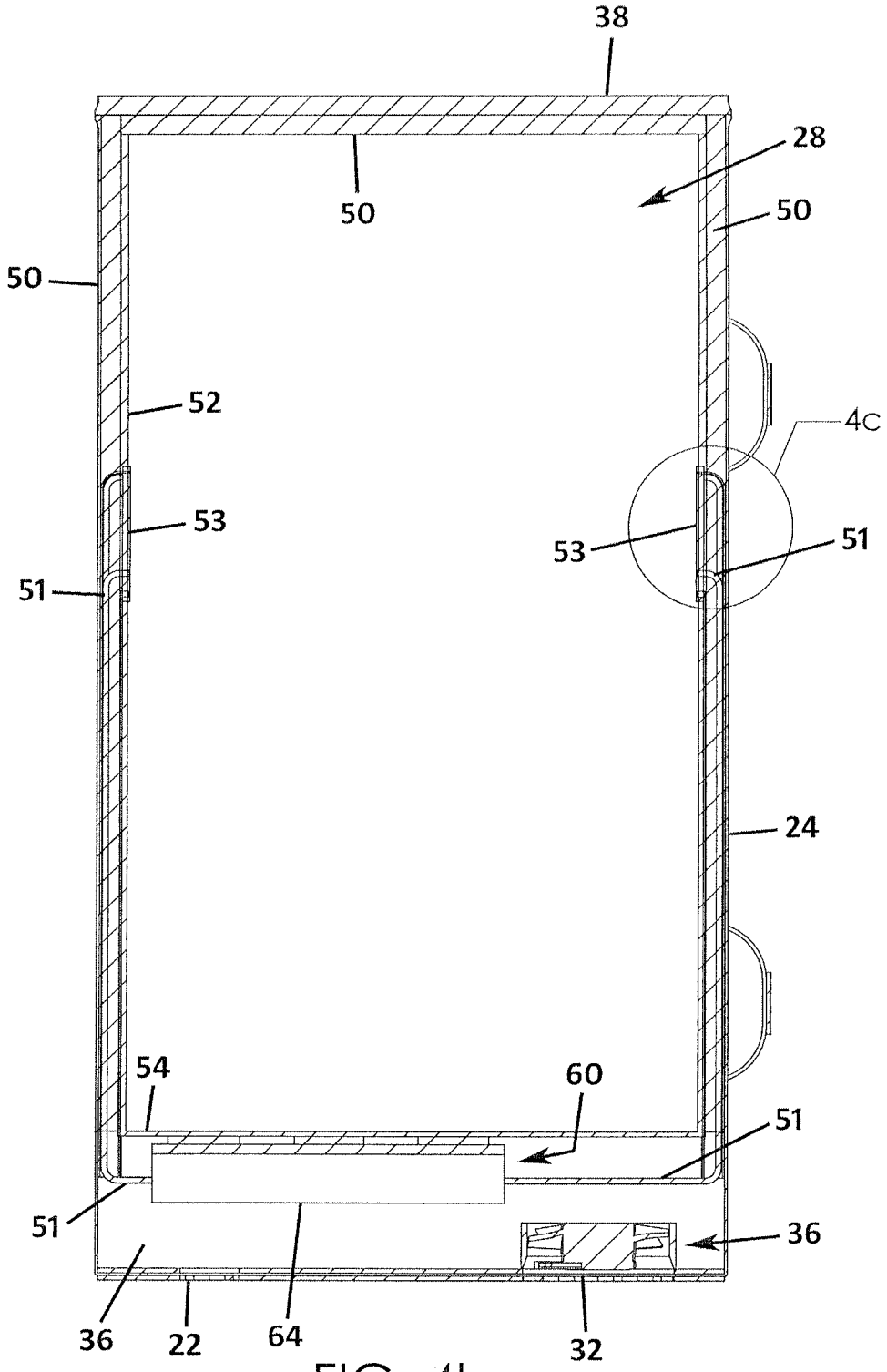
FIG. 4*b* is a sectional view taken along line 4*a*-4*a* of FIG. 4*b;*

The housing 20 includes an insulation layer 50. The insulation layer 50 is coupled to an inner surface of the wall structure 24 of the housing 20 (FIG. 4*b*). The insulation layer 50 may be constructed of polyurethane foam or polypropylene, or a combination thereof. A portion of the insulation layer 50 may be adhered to a bottom surface of the lid 38 so as to be moved away from the interior area when the lid 38 is at the open configuration (FIG. 2) but to face the interior area 28 at the closed configuration (FIG. 1). The insulation layer 50 has the characteristic of maintaining a temperature within the interior area 28, such as a cooled temperature when the thermoelectric assembly 60 is energized, as will be described later.

A conductive lining 52 is situated adjacent an inner surface of the insulation layer 50 along the side wall within the housing 20. The conductive lining 52 may be a thin aluminum material that is capable of conducting or transferring thermal energy, i.e. a temperature. The conductive lining 52 includes an aluminum cooling plate 54 extending between lower ends of the insulation layer 50 and upwardly displaced from the bottom wall 22 of the housing 20. The cooling plate 54, lower portions of the wall structure 24, and the bottom wall 22 of the housing 20 form a compartment 56 that is substantially hollow (FIG. 4*b*).

The thermoelectric assembly 60 includes a plurality of thermoelectric elements 62 positioned atop an aluminum heat sink 64. The thermoelectric assembly 60 may be electrically connected to the battery of a motorcycle, such as with an electrical cord and a polarized electrical plug 66 which, in some embodiments may alternatively be an inverter. In an embodiment, the thermoelectric assembly 60 may be plugged in using a 2-prong quick disconnect plug. It is understood that the cord may be held securely to the wall structure 24 of the housing 20 with an elastic cord strap 21. The thermoelectric assembly 60 is configured to become cool on the top side having the plurality of thermoelectric elements 62 and becomes hot on the bottom side at the heat sink 64. Therefore, the thermoelectric assembly 60 is accurately described as having a cool side and an opposed hot side when energized by electrical current. In an embodiment, the cool side of the thermoelectric assembly 60 is coupled to a lower surface of the cooling plate 54 and the hot side extends downwardly therefrom. The entire thermoelectric assembly 60 is situated in the compartment 56 of the housing 20 (FIG. 4*b*). The thermoelectric elements 62 that become cold when energized cause the conductive (aluminum) material of the cooling plate 54 to become cold, the cold representing thermal energy that is conductively transferred to the rest of the conductive lining and to ambient air within the housing 20. Accordingly, the air within the interior area 28 of the housing 20 is cooled when the thermoelectric assembly 60 is energized—the insulation layer 50 acting to maintain the temperature even when current is terminated, such as if the entire housing 20 is carried away from the motorcycle.

Figure 4C:
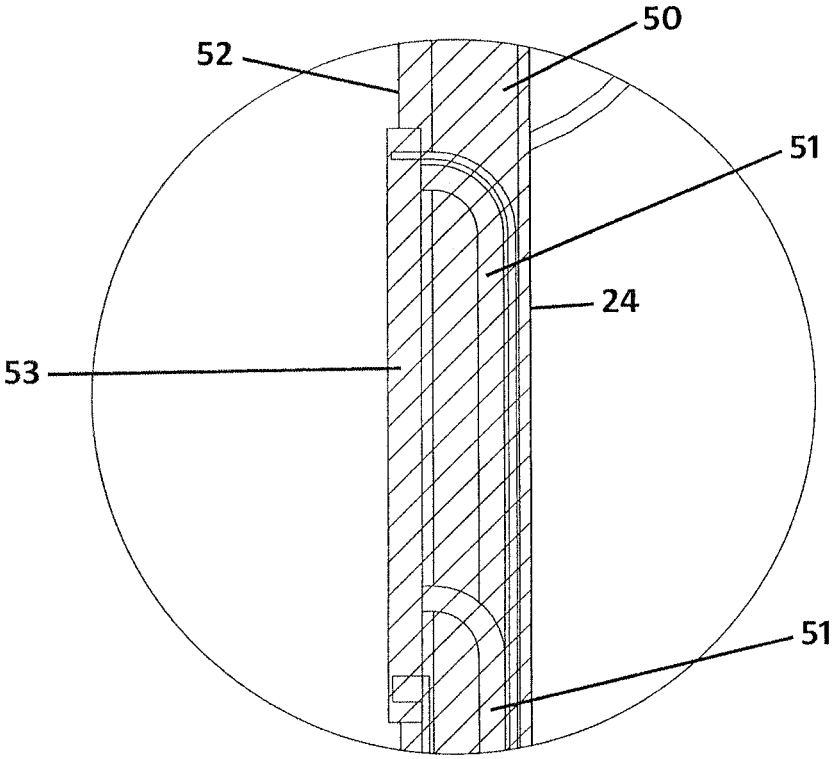
Figure 5:
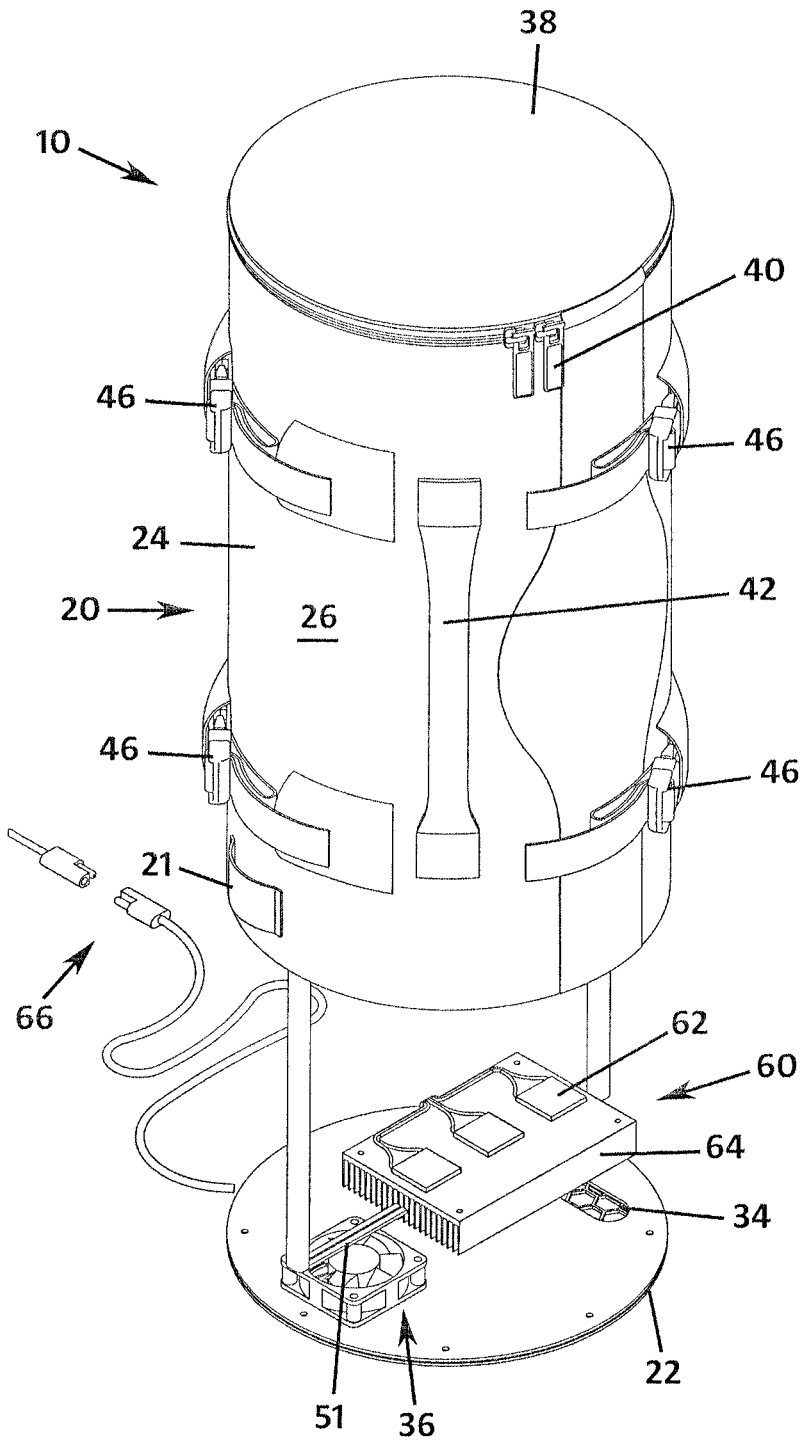
FIG. 5 is an exploded view of the thermoelectric insulated cooling apparatus as in FIG. 1.
Figure 6A:
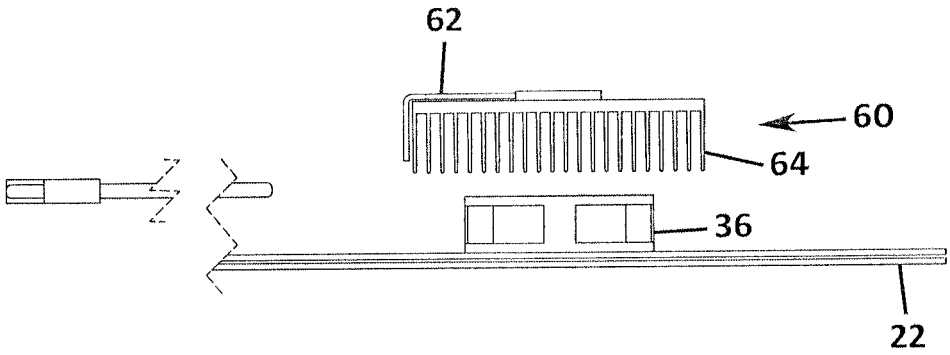
FIG. 6*a* is a side view of the compartment and electrical components removed from the housing of the thermoelectric insulated cooling apparatus as in FIG. 5.
Figure 6B:
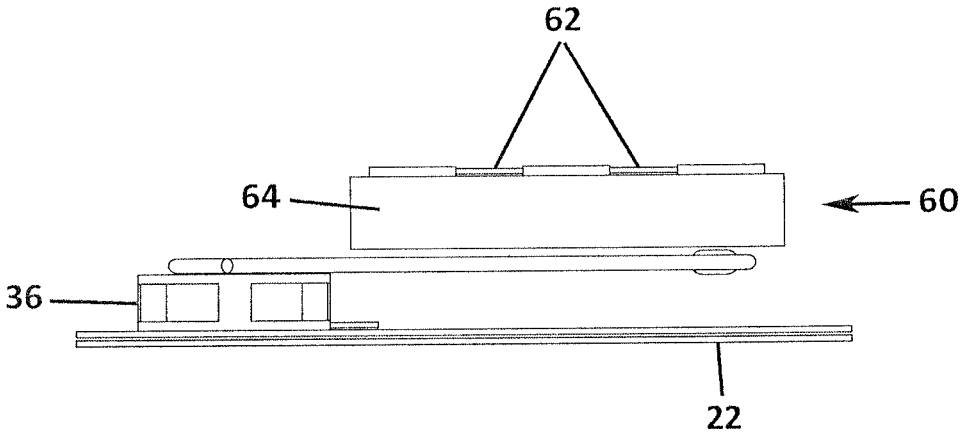
FIG. 6*b* is view from another angle of the compartment and electrical components as in FIG. 6*a;*
Figure 6C:
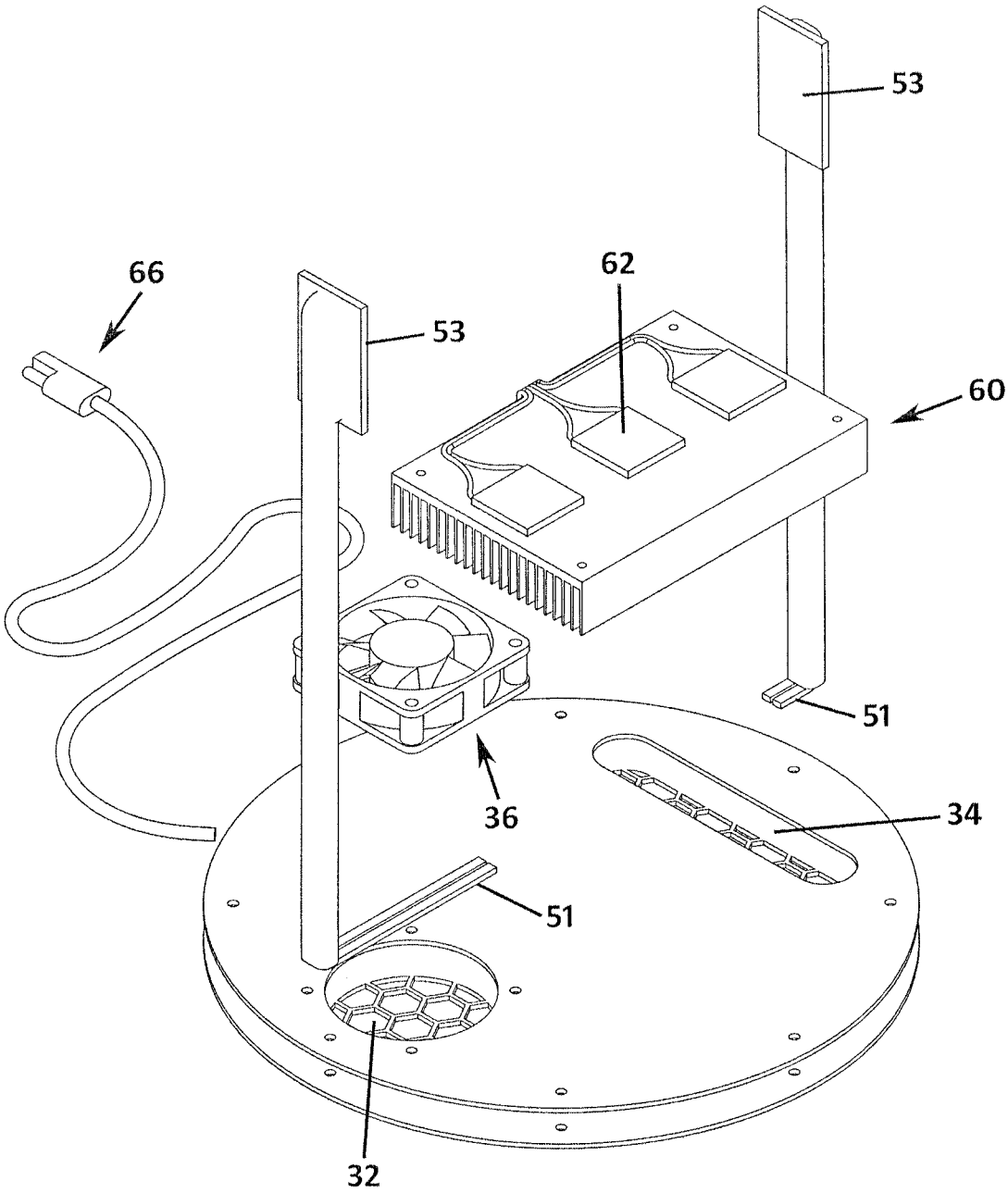
FIG. 6*c* is an exploded view of the compartment and electrical components as in FIG. 6*a;*
Figure 7:
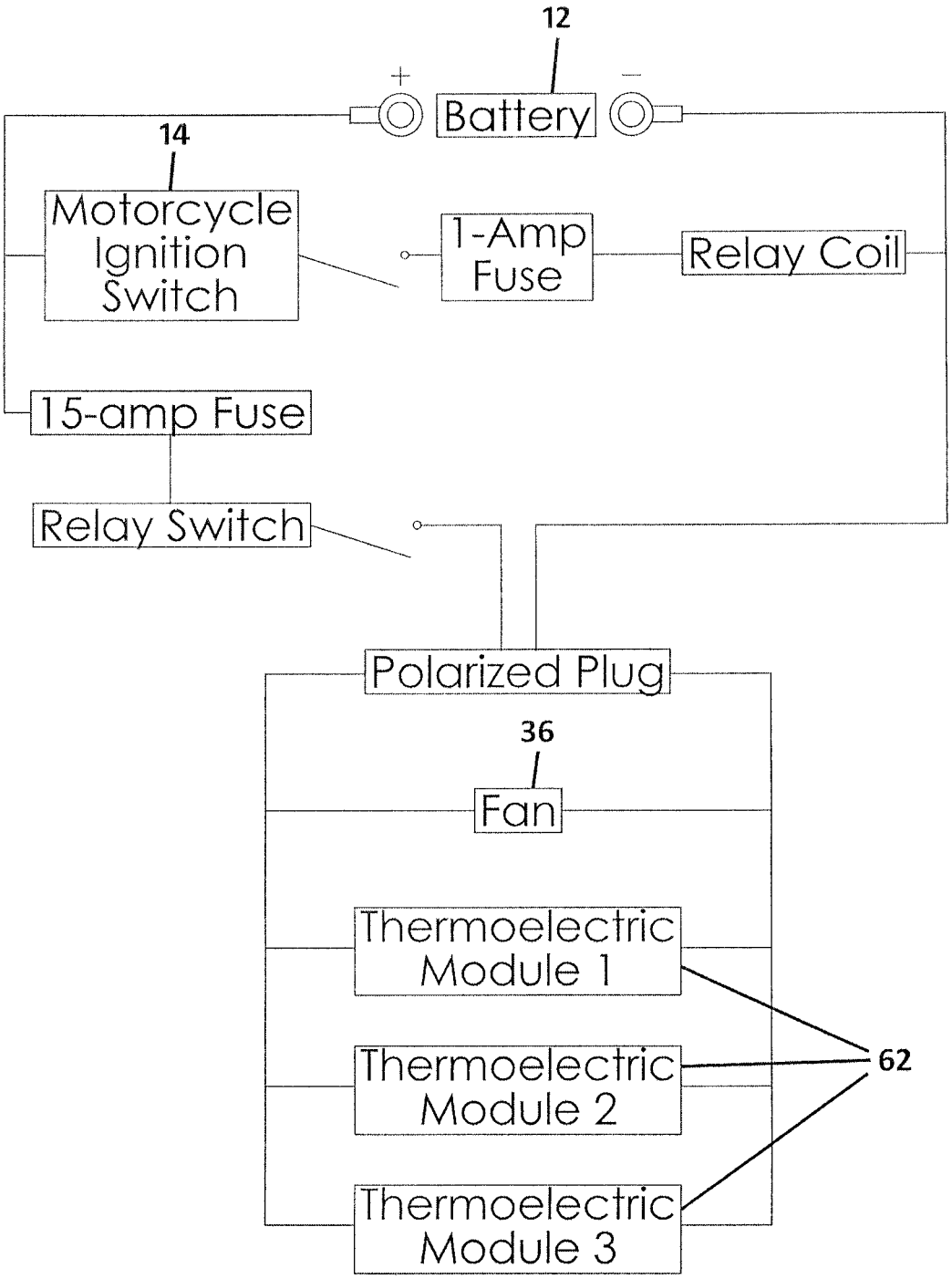
FIG. 7 is a schematic diagram of the electrical components of the present invention.
Figure 8:
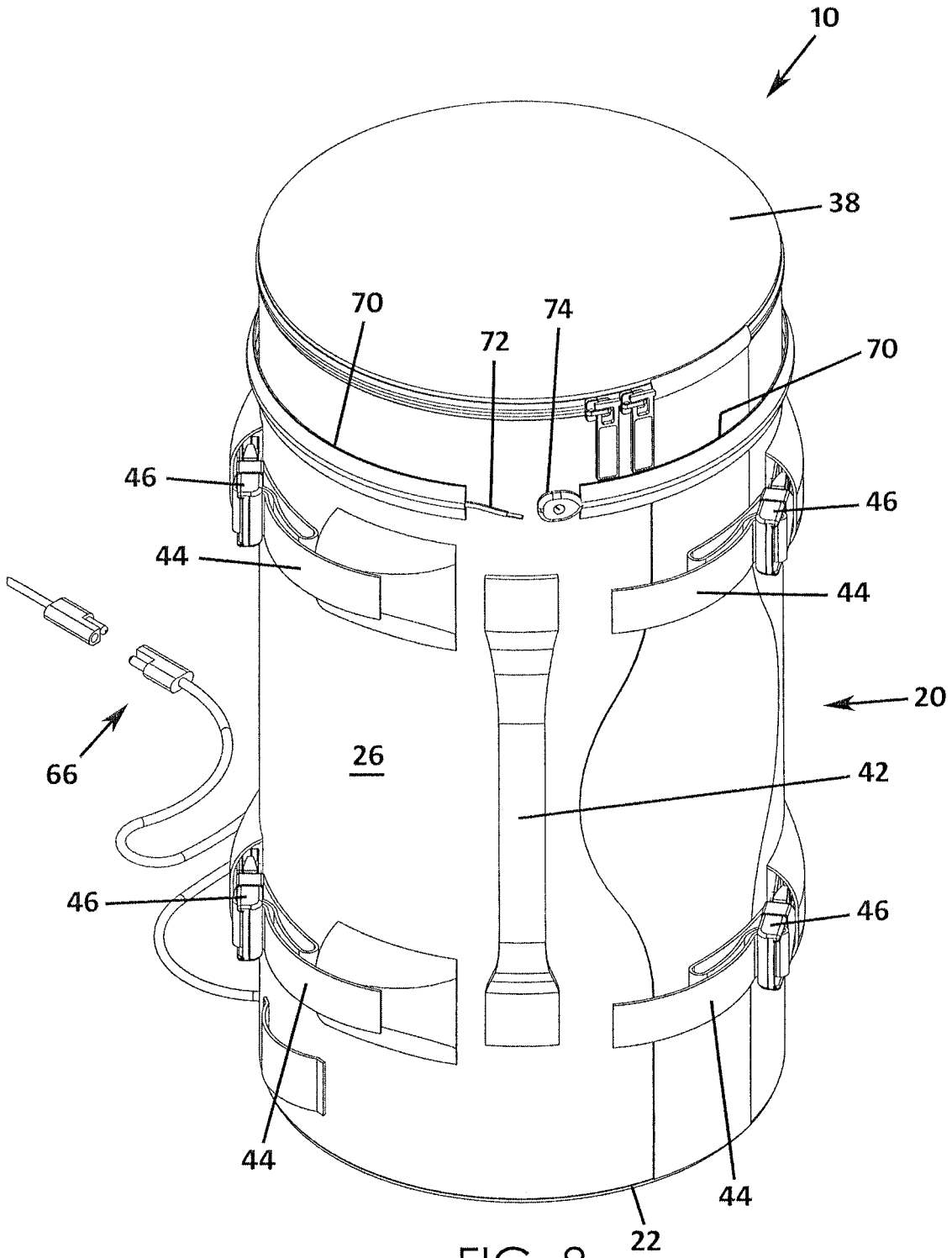
FIG. 8 is a perspective view of a thermoelectric insulated cooling apparatus according to another embodiment of the present invention illustrating a locking assembly in an unlocked configuration.
Figure 9:
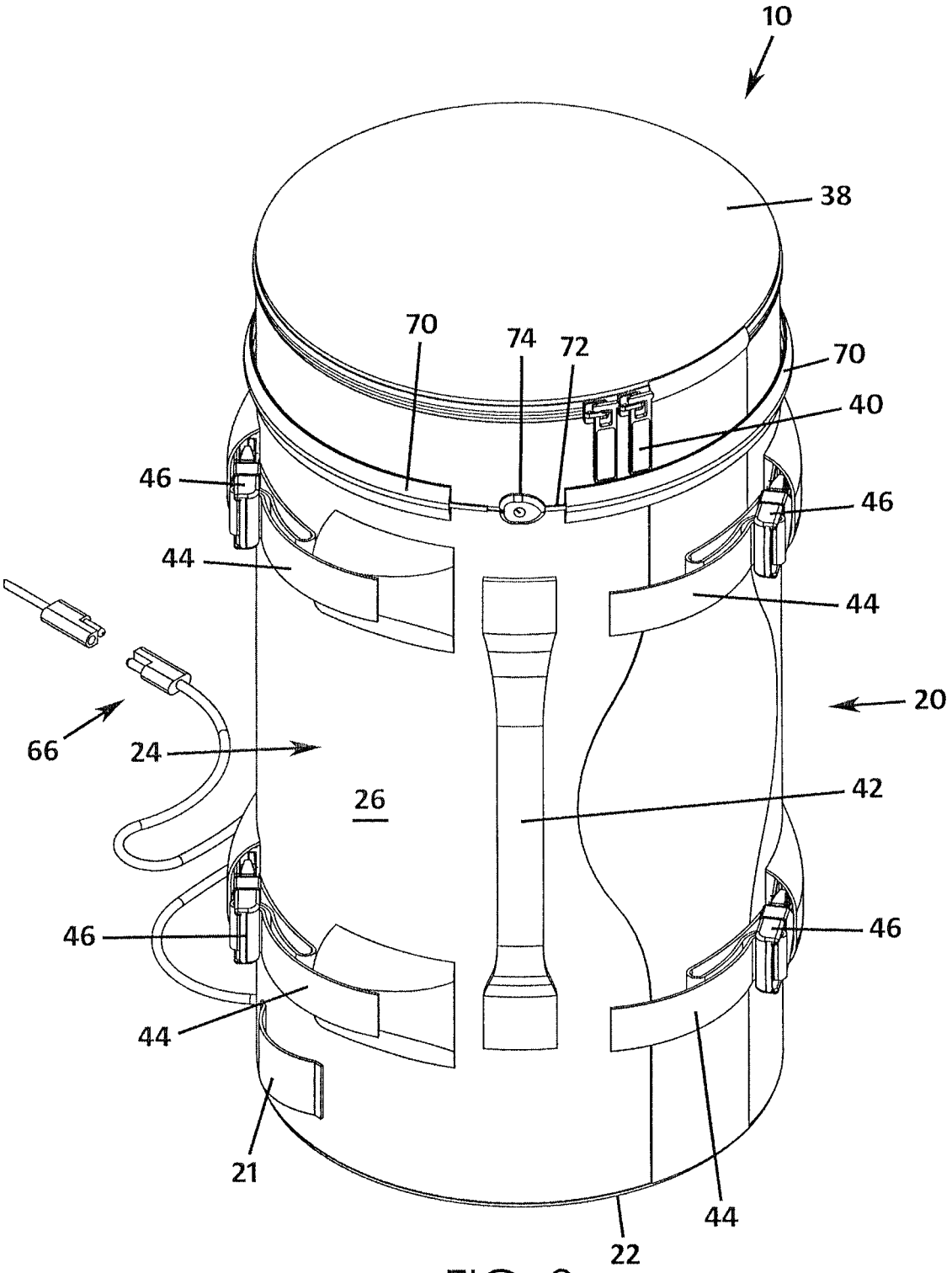
FIG. 9 is another view of the thermoelectric insulated cooling apparatus as in FIG. 8, illustrating the locking assembly in a locked configuration.
Figure 10A:
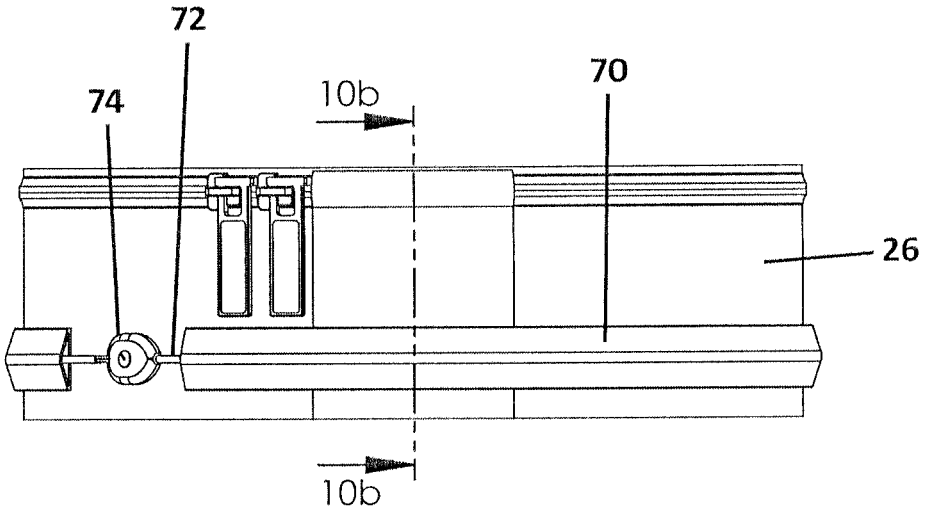
FIG. 10*a* is an isolated view on an enlarged scale of the locking assembly.
Figure 10B:
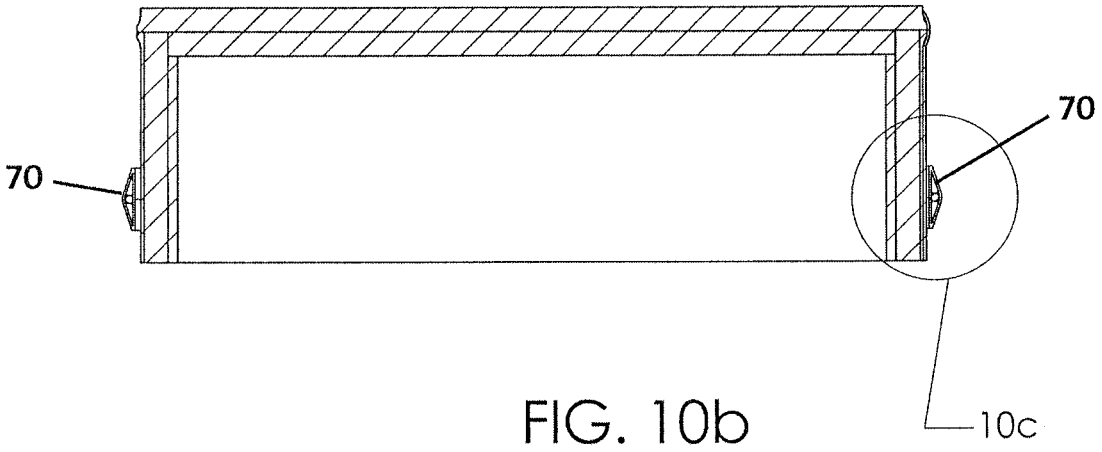
FIG. 10*b* is a sectional view taken along line 10*b*-10*b* from FIG. 10*a*.
Figure 10C:
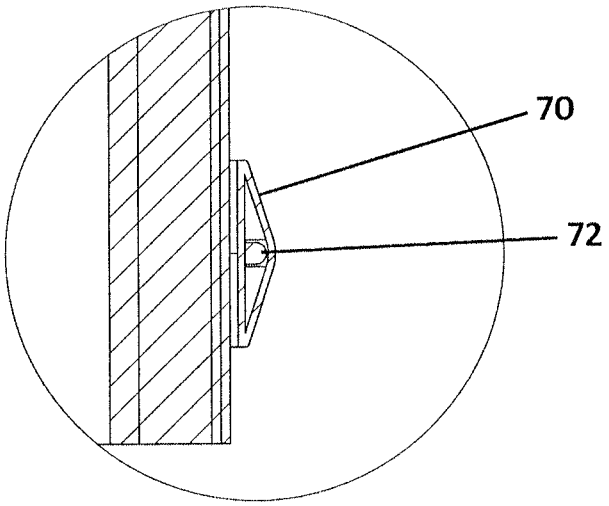
FIG. 10*c* is an isolated view on an enlarged scale taken from FIG. 10*b*.

Further, additional structures are incorporated into the thermoelectric cooling apparatus 10 to keep the inner walls of the housing 20 cooler than previous coolers. More particularly, at least a pair of heat pipes 51 (and, preferably, two per side) is coupled at a first end to at least one but preferably four thermoelectric elements 62 of the thermoelectric assembly 60 and at a second end to associated thermoelectric disks and mounting plates 53 of the conductive lining 52 of the housing 20 (FIGS. 4*b* and 4*c*). The thermoelectric disk and mounting plate 53 is positioned about midway between the bottom wall 22 of the housing 20 and the upper edge of the side wall 24. This centered position is important to infuse coolness to the conductive lining 52 more quickly than through normal conduction from the cool plate 54 and conductive lining 52 as described previously. Stated in a converse perspective, the heat pipes 51 conduct heat away from the conductive lining 52 to the thermoelectric assembly 60 where it may be exhausted as described. The heat pipes 51 may be constructed of solid copper or another highly conductive material for enhanced and auxiliary conduction. Preferably, the heat pipes have a slightly flattened and not purely cylindrical configuration. The heat pipes 51 may be routed outside the insulation layer 50 of the housing 20 to the thermoelectric assembly 60 yet are positioned inside the outer side wall 24. The heat pipes 51 are surrounded and protected by a heat shield cover (similar to how copper wire is surrounded by a covering material). It is understood that the copper pipes may be situated outside of the insulation layer 50 of the cooler itself.

The bottom wall 22 of the housing 20 defines an outlet opening 32 and an inlet opening 34 displaced from the outlet opening 32. The thermoelectric assembly 60 includes a fan 36 positioned in the compartment 56 proximate the outlet opening 32 and configured to direct air heated by the hot side of the thermoelectric assembly 60 out of the compartment 56 and housing 20 via the outlet opening 32. The outlet opening 32, which may also be referred to as an exhaust vent, may be covered by a grate or vent cover to prevent objects from interfering or damaging the fan 36. The inlet opening 34 is configured to allow fresh ambient air from outside the housing 20 to enter the compartment 56 as warm air is exhausted therefrom.

With further reference to the housing 20, the wall structure 24 may be constructed substantially of leather although flexible plastic, vinyl, or fabric would also be suitable. A carrying strap 42 may be coupled to an outer surface of the side wall 26 and configured to be grasped by the hand of a user for carrying the entire housing 20 or positioning it to be strapped to a motorcycle. Further, a plurality of mounting straps may be coupled to the outer surface of the wall structure, each mounting strap 44 including one or more buckles 46 configured to enable the housing 20 to be selectively mounted to a rear seat, backrest, luggage rack, saddlebag, or frame of a motorcycle. In other words, the motorcycle includes a plurality of mounting structures to which one or more mounting straps 44 may be attached and, as a result, the thermoelectric cooling apparatus 10 may be mounted securely to a motorcycle. Stated still another way, the rear seat, backrest, luggage rack, saddlebag, or frame of a motorcycle constitute and may be referred to later as the mounting structures to which the thermoelectric cooling apparatus 10 may be mounted to a motorcycle.

In another aspect, the thermoelectric cooling apparatus 10 includes a theft prevention feature. More particularly, the apparatus includes a locking assembly coupled to the outer surface of the side wall 26 of the housing 20. Preferably, the locking assembly includes a sleeve 70 attached to the outer surface of the side wall 26 that defines an interior channel between the sleeve 70 and the side wall 26. In other words, the outer edges of the sleeve 70 may be fixedly attached to the side wall 26 while a middle portion thereof defines the open interior channel. The sleeve 70 extends substantially around an entire circumference of the side wall 26 and defines open inlet and outlet ends.

Then, the locking assembly includes a locking cable 72 positioned in the channel of the sleeve 70 so as to be hidden substantially and protected from damage, vandalism, or cutting by a thief. The locking cable 72 includes opposed proximal and distal ends that may be visible and extend from respective inlet and outlet ends of the sleeve 70. The sleeve may define additional inlets and outlets (not shown) such as at spaced apart points on respective sides and back of the side wall 26. It is understood, therefore, that the locking cable 72 may be selectively wrapped around or through respective attachment structures of the motorcycle for securely mounting the thermoelectric cooling apparatus 10 to the motorcycle. Further, the locking assembly includes a lock 74 coupled to either the proximal end or distal end of the locking cable, the lock configured to selectively receive the other end thereof in a locking arrangement.

In use, the housing 20 of the thermoelectric cooling apparatus 10 may be mounted to a rear portion of a seat or the frame of a motorcycle using the mounting straps 44. If desired, the apparatus may be locked to the motorcycle using the locking assembly described above. The lid 38 may be opened and food or beverage items may be inserted into the interior area 28. Using the electrical plug 66 or inverter and associated electrical cord, the thermoelectric assembly 60 situated in the compartment 56 of the housing 20 may be electrically connected to the motorcycle's battery 12 or, indirectly, to the ignition switch. Upon being plugged in, the thermoelectric assembly 60 is energized, causing the cool side to become cold and the hot side to become hot. The cold temperature energy is transferred by conduction to the cooling plate 54, conductive lining 52, and air within the interior area, so as to cool items therein. The insulation layer 50 effectively maintains the cooled temperature within the housing 20.

It is understood that while certain forms of this invention have been illustrated and described, it is not limited thereto except insofar as such limitations are included in the following claims and allowable functional equivalents thereof.

The invention claimed is:

1. A thermoelectric cooling apparatus for use with a motorcycle, the motorcycle having a mounting structure and a battery, comprising:

a housing having a bottom wall and a wall structure extending upwardly from said bottom wall that defines an interior area and an open top that provides access to said interior area;

a mounting strap mounted to an outer surface of said wall structure of said housing and attachable to the exterior attachment structure of the motorcycle, said mounting strap extending partially between said lid and said bottom wall;

wherein said housing includes an insulation layer coupled to an inner surface of said wall structure of said housing;

a locking assembly coupled to said outer surface of said wall structure of said housing, said locking assembly comprising:

a sleeve attached to said outer surface and extending along a circumference thereof, said sleeve having an inner channel with an open inlet and an open outlet;

a locking cable positioned in said inner channel of said sleeve, a portion of said locking cable extending outside of said open inlet and said open outlet for selective attachment to the exterior attachment structure of the motorcycle;

a lock coupled to a proximal end of said locking cable for selectively receiving a distal end of said locking cable in a locked engagement;

a conductive lining situated adjacent to said insulation layer within said housing, said conductive lining having an aluminum cooling plate upwardly displaced from said bottom wall such that said bottom wall, said wall structure and said cooling plate defining a hollow compartment; and a thermoelectric assembly situated in said compartment having a "cool" side coupled to a lower surface of said cooling plate of said lining via a thermoelectric element and an opposed "hot" side, said thermoelectric assembly configured to receive electric current from the battery of the motorcycle such that said thermoelectric assembly conductively cools said cooling plate and said lining when energized.

2. The thermoelectric cooling apparatus as in claim 1, wherein said housing includes a lid pivotally connected to an upper edge of said wall structure and movable between an open configuration providing access to said interior area and a closed position preventing access to said interior area.

3. The thermoelectric cooling apparatus as in claim 2, wherein said lid is selectively secured at said closed configuration by a fastener taken from the group including a zipper, a latch, a buckle, a magnet, and a friction fit arrangement.

4. The thermoelectric cooling apparatus as in claim 1, further comprising a power inverter electrically connected to said thermoelectric assembly and configured to direct current from the motorcycle battery to said thermoelectric assembly via an electrically conductive cable.

5. The thermoelectric cooling apparatus as in claim 1, wherein:

said bottom wall of said housing defines an outlet opening;

said theremoelectric cooling apparatus further comprises a fan positioned in said compartment proximate said outlet opening, said fan configured to exhaust air heated by said hot side of said thermoelectric assembly outwardly through said outlet opening.

6. The thermoelectric cooling apparatus as in claim 5, wherein said bottom wall of said housing defines an inlet opening displaced from said outlet opening and configured to draw fresh air into said compartment when heated air is exhausted out of said compartment via said outlet opening.

7. The thermoelectric cooling apparatus as in claim 2, wherein a portion of said insulative layer is fixedly attached to a lower surface of said lid and is removed from a remainder of said insulated layer when said lid is moved to said open configuration.

8. The thermoelectric cooling apparatus as in claim 2, further comprising a carrying strap mounted to an outer surface of said wall structure of said housing and configured to extend partially between said lid and said bottom wall.

9. The thermoelectric cooling apparatus as in claim 1, further comprising a heat pipe constructed of a conductive material having a first end operatively connected to said thermoelectric element of said cool side of said thermoelectric assembly and a second end displaced from said first end that is operatively connected to said conductive lining of said housing at a position upwardly displaced from said cooling plate, said heat pipe extending through said insulation layer between said first and second ends, respectively.

10. The thermoelectric cooling apparatus as in claim 1, wherein said second end of said heat pipe is coupled to a thermoelectric disk mounted to said conductive liner.

11. A thermoelectric cooling apparatus for use with a motorcycle, said motorcycle having a plurality of mounting structures and a battery, comprising:

a housing having a bottom wall and a continuous side wall extending upwardly from said bottom wall that defines an interior area and an open top that provides access to said interior area;

a plurality of mounting straps mounted to an outer surface of said wall structure of said housing and attachable to said plurality of mounting structures of the motorcycle, respectively, said strap extending partially between said lid and said bottom wall;

wherein at least one of said mounting straps includes a buckle selectively mounting said housing to a selected mounting structure of the motorcycle;

a locking assembly coupled to said outer surface of said wall structure of said housing, said locking assembly comprising:

a sleeve attached to said outer surface and extending along a circumference thereof, said sleeve having an inner channel with an open inlet and an open outlet;

a locking cable positioned in said inner channel of said sleeve, a portion of said locking cable extending outside of said open inlet and said open outlet for selective attachment to the exterior attachment structure of the motorcycle;

a lock coupled to a proximal end of said locking cable for selectively receiving a distal end of said locking cable in a locked engagement;

wherein said housing includes:

a lid pivotally connected to an upper edge of said side wall and movable between an open configuration providing access to said interior area and a closed position preventing access to said interior area;

an insulation layer coupled to an inner surface of said wall structure of said housing;

a conductive lining situated adjacent to said insulation layer within said housing, said conductive lining having an aluminum cooling plate upwardly displaced from said bottom wall such that said bottom wall, said wall structure and said cooling plate define a hollow compartment;

a thermoelectric assembly situated in said compartment having a "cool" side coupled to a lower surface of said cooling plate of said lining via at least one thermoelectric element and an opposed "hot" side, said thermoelectric assembly configured to receive current from the battery of the motorcycle such that said thermoelectric assembly conductively cools said cooling plate and said lining when energized; and a heat pipe constructed of a conductive material having a first end operatively connected to at least one thermoelectric element of said thermoelectric assembly and a second end displaced from said first end and operatively connected to said conductive lining of said housing at a position upwardly displaced from said cooling plate, said heat pipe extending through said insulation layer between said first and second ends, respectively.

12. The thermoelectric cooling apparatus as in claim 11, wherein:

said bottom wall of said housing defines an outlet opening;

said thermoelectric cooling apparatus further comprises a fan positioned in said compartment proximate said outlet opening, said fan configured to exhaust air heated by said hot side of said thermoelectric assembly outward through said outlet opening.

13. The thermoelectric cooling apparatus as in claim 12, wherein said bottom wall of said housing defines an inlet opening displaced from said outlet opening and configured to draw fresh air into said compartment when heated air is exhausted out of said compartment via said outlet opening.

14. The thermoelectric cooling apparatus as in claim 11, wherein said lid is selectively secured at said closed configuration by a fastener taken from the group including a zipper, a latch, a buckle, a magnet, and a friction fit arrangement.

15. The thermoelectric cooling apparatus as in claim 11, further comprising a power inverter electrically connected to said thermoelectric assembly configured to deliver current from the motorcycle battery to said thermoelectric assembly via a cable.

16. The thermoelectric cooling apparatus as in claim 11, wherein a portion of said insulative layer is fixedly attached to a lower surface of said lid and is removed from a remainder of said insulated layer when said lid is moved to said open configuration.

17. The thermoelectric cooling apparatus as in claim 11, further comprising a carrying strap mounted to an outer surface of said wall structure of said housing and configured to extend partially between said lid and said bottom wall.

18. The thermoelectric cooling apparatus as in claim 11, wherein said second end of said heat pipe is coupled to a thermoelectric disk mounted to said conductive liner at a position about midway between said bottom wall and said upper edge of said side wall.

* * * * *